US005515063A

United States Patent [19]

Martin

[11] Patent Number: 5,515,063

[45] Date of Patent: May 7, 1996

[54] BROADCASTING SET COMPRISING A RIGID-DIPOLE ROTARY ANTENNA AND ROTATING JOINT DESIGNED FOR THIS SET

[75] Inventor: Jean-Marc Martin, St Leu La Foret, France

[73] Assignee: Thomson-CSF, Paris, France

[21] Appl. No.: 323,127

[22] Filed: Oct. 14, 1994

[30] Foreign Application Priority Data

Oct. 15, 1993 [FR] France ..... 93 12286

[51] Int. Cl.[6] ..... H01Q 21/12

[52] U.S. Cl. ..... 343/815; 343/818; 343/820; 343/876

[58] Field of Search ..... 343/763, 815, 343/816, 818, 820, 876, 890, 858; 333/261

[56] References Cited

U.S. PATENT DOCUMENTS

| | | | |
|---|---|---|---|
| 3,914,715 | 10/1975 | Hubing et al. | 333/261 X |
| 4,543,549 | 9/1985 | Meltzer et al. | 343/763 X |
| 4,780,725 | 10/1988 | Ursenbach | 343/815 |
| 5,012,170 | 4/1991 | Atlas | 318/611 |
| 5,146,233 | 9/1992 | Ursenbach | 343/815 |

FOREIGN PATENT DOCUMENTS

| | | | |
|---|---|---|---|
| 0002233 | 6/1979 | European Pat. Off. | 343/763 |
| 0052231 | 5/1982 | European Pat. Off. | 343/763 |

*Primary Examiner*—Donald T. Hajec
*Assistant Examiner*—Tho Phan
*Attorney, Agent, or Firm*—Oblon, Spivak, McClelland, Maier & Neustadt

[57] ABSTRACT

The disclosure relates to broadcasting by means of rotary antennas using rigid dipoles. Each of two distinct channels passes through the joint between the fixed support of the mobile part of the antenna and rise vertically into the interior of the mast to respectively reach two distinct vertical groups of dipoles. It is thus possible to carry out two simultaneous transmissions from one and the same rotary antenna. Application to broadcasting in decameter waves.

4 Claims, 4 Drawing Sheets

Figures 1, 2:
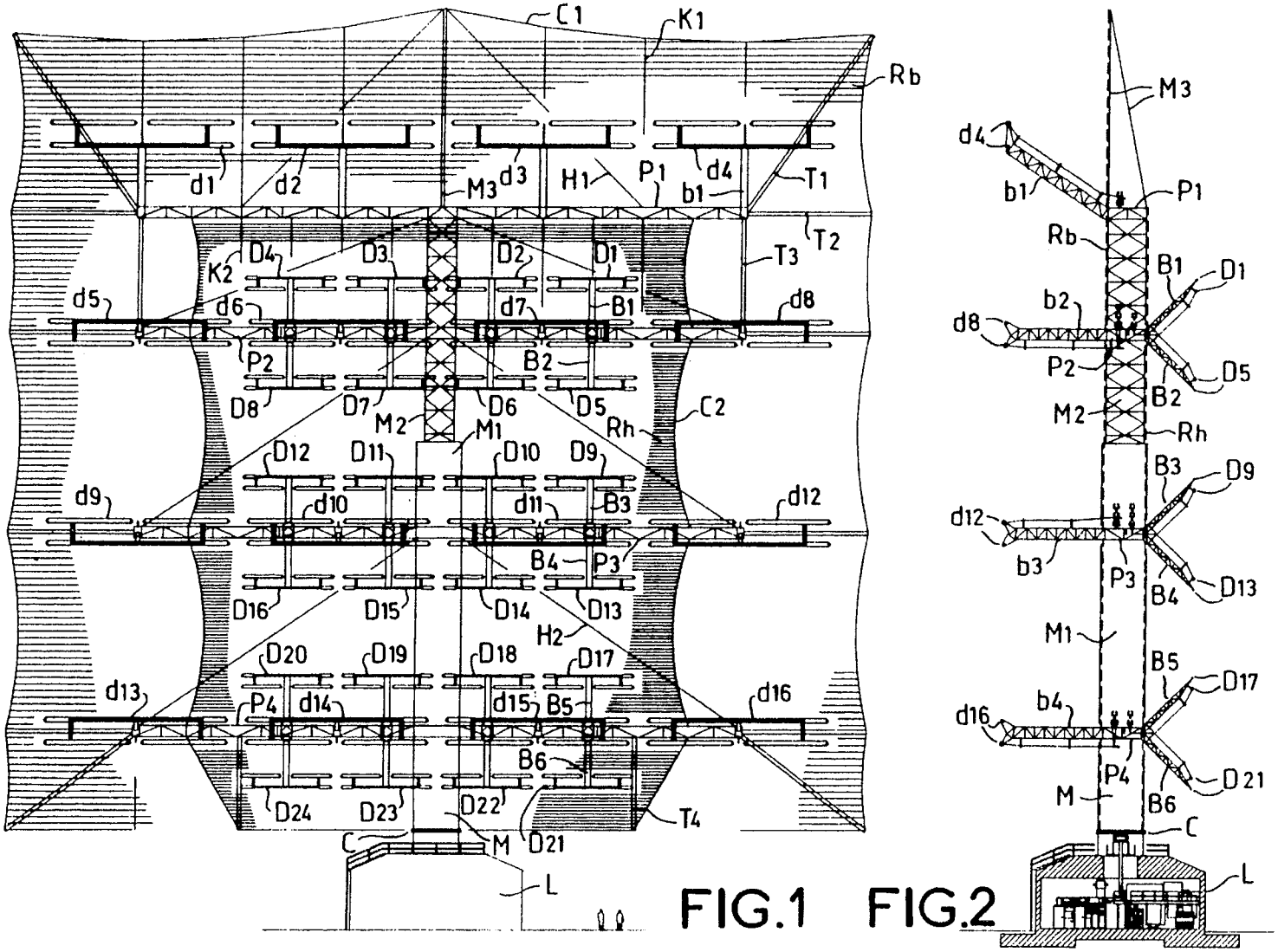

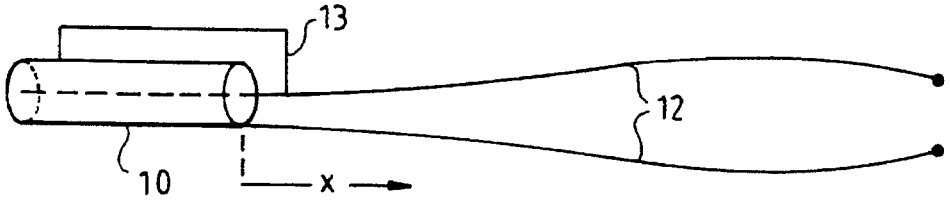
FIG.6
FIG.7
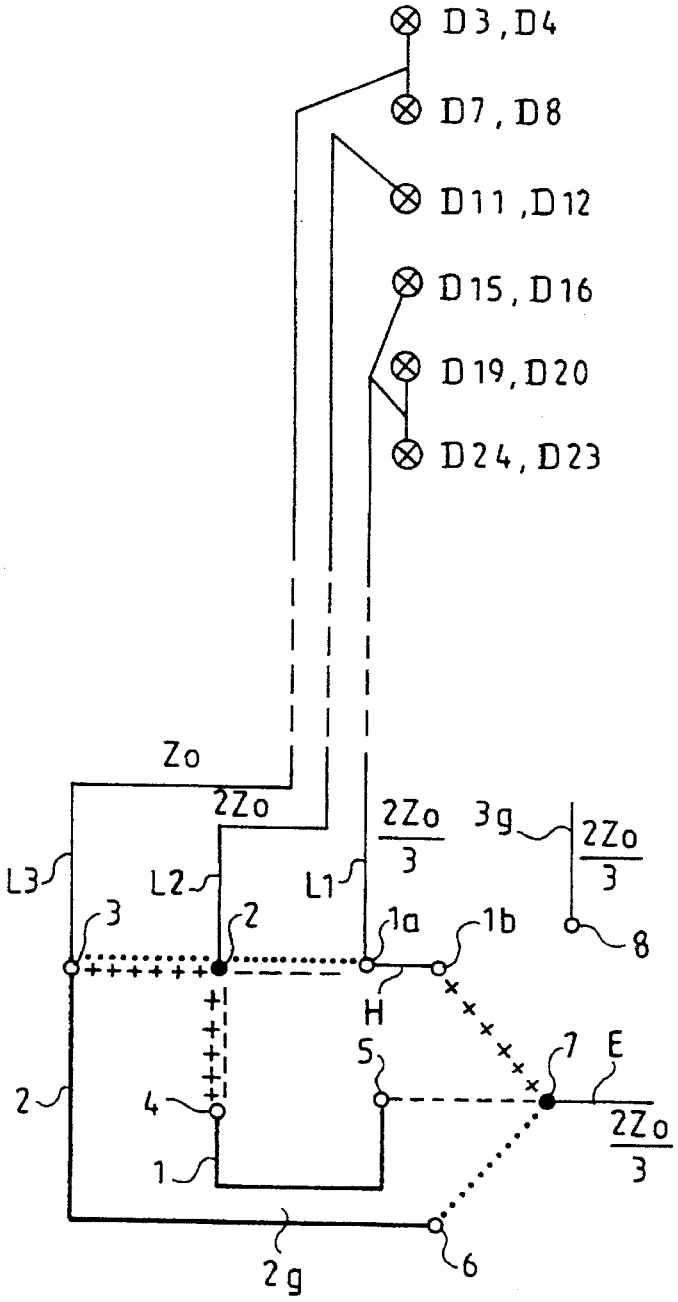

BROADCASTING SET COMPRISING A RIGID-DIPOLE ROTARY ANTENNA AND ROTATING JOINT DESIGNED FOR THIS SET

BACKGROUND OF THE INVENTION

The present invention relates to broadcasting sets comprising a rigid dipole rotary antenna designed to work with decameter waves.

Sets of this kind exist. Their rotary antenna has a fixed base surmounted by a vertical mast which, in association with horizontal girders, most generally supports two parallel vertical curtains of rigid dipoles separated by one or two vertical curtains of horizontal wires that play the role of wave reflectors. Certain antennas have only one curtain of dipoles associated with one curtain of wires. Each curtain of dipoles, with its reflector, constitutes an antenna proper. In certain applications, a portion of the dipoles of this antenna, according to choice, may or may not be powered, this being achieved by means of switching assemblies. Hereinafter, the complete set with the curtains of dipoles and the reflector curtain or curtains shall be called a rotary antenna whenever it is necessary to avoid confusion with the two antennas proper, which are also called antenna faces or dipole curtains or high-range antennas and low-range antennas. The latter two terms express the fact that, of the two curtains of dipoles of a rotary antenna, one is designed to work in high frequencies, for example in the 13/15/17/21/26 MHz bands located between 13,600 and 26,100 MHz while the other is designed to work in the low frequencies, for example in the 6/7/9/11 MHz bands located between 5,950 and 12,050 MHz.

The dipoles of each of the two curtains are generally arranged in rows and columns, symmetrically with respect to the projection of the axis of the mast in the plane of the curtain. As for the power supply to the dipoles, it is provided by means of feeders which go into the mast and set up links between a transmission source on the ground and either of the two curtains of dipoles.

The rotary antennas presently in operation use only one transmission source at a time. This is especially so in high-powered broadcasting. Now, given the cost of a broadcasting antenna whose height goes up to several tens of meters, it would be useful to be able to use these antennas together with two transmission sources transmitting simultaneously. Indeed, broadcasting stations are now increasingly transmitting in dual frequencies in one and the same direction, i.e., one and the same program is sent out in one and the same direction on two different frequencies, for example, 6 and 7 MHz. For this purpose, there is a known way of using two rotary antennas, each with one transmitter. Sending one and the same program on two frequencies is therefore a costly approach since it requires two rotary antennas and since one rotary antenna is very costly.

SUMMARY OF THE INVENTION

The present invention is aimed at overcoming this drawback by proposing a broadcasting set having only one rigid-dipole rotary antenna that is capable, however, of working in at least the following two configurations:

- two transmissions on one face of the rotary antenna respectively on two different frequencies,
- one transmission on a complete face of the rotary antenna on one and the same frequency, and, furthermore, in the case of a rotary antenna with two curtains of dipoles, in the following configuration:

- two transmissions: one on one face of the rotary antenna on a first frequency and one on the other face on a second frequency that is different from the first frequency; it must be noted that when the two curtains of dipoles are separated by two distinct reflector curtains, one only for the high frequencies and the other only for the low frequencies, the transmission frequencies on the two faces may be the same provided that at least one frequency band is common to the high frequencies and to the low frequencies.

This is obtained especially by giving one vertical part of the rotary antenna a feeder line that is independent of the feeder line designed for the other vertical part.

According to the present invention, there is provided a broadcasting set formed by transmission means and a rotary antenna, the transmission means comprising two transmitters each with one output impedance matching unit and supply means for the antenna, the antenna comprising a support with a fixed base, a vertical mast, a bi-coaxial rotating joint positioned between the base and the mast, m, with m as a positive integer smaller than 3, vertical reflector curtains and n, with n as an integer and $m \leqq n < 3$, parallel vertical curtains of rigid dipoles fixedly joined to the mast, each associated with one of the reflector curtains, the supply means having two distinct channels that respectively leave the two transmitters, go into the joint and rise within the mast up to the level of the dipoles to respectively supply at least certain of the dipoles distinct vertical portions of the n curtains of dipoles, the channels each comprising a symmetrizer positioned in the mast.

According to the present invention, there is further provided a rotating joint for a broadcasting set provided with a rigid-dipole rotary antenna, this joint having: a metal pack formed by two half-packs in contact along a circular plane zone, one of the half-packs being fixed, the other being capable of rotating while keeping the contact along the circular zone, two coaxial ports per half-pack, these ports each having an external conductor in electrical contact with its half-pack and an internal conductor that penetrates its half-pack and at least two of the four internal conductors of the four ports of the pack being extended into the pack by sliding contacts, parallel to the plane zone, to set up two electrical links beginning respectively on the two ports of one of the half-packs and respectively reaching the two ports of the other of the half-packs.

BRIEF DESCRIPTION OF THE INVENTION

Figure 3:
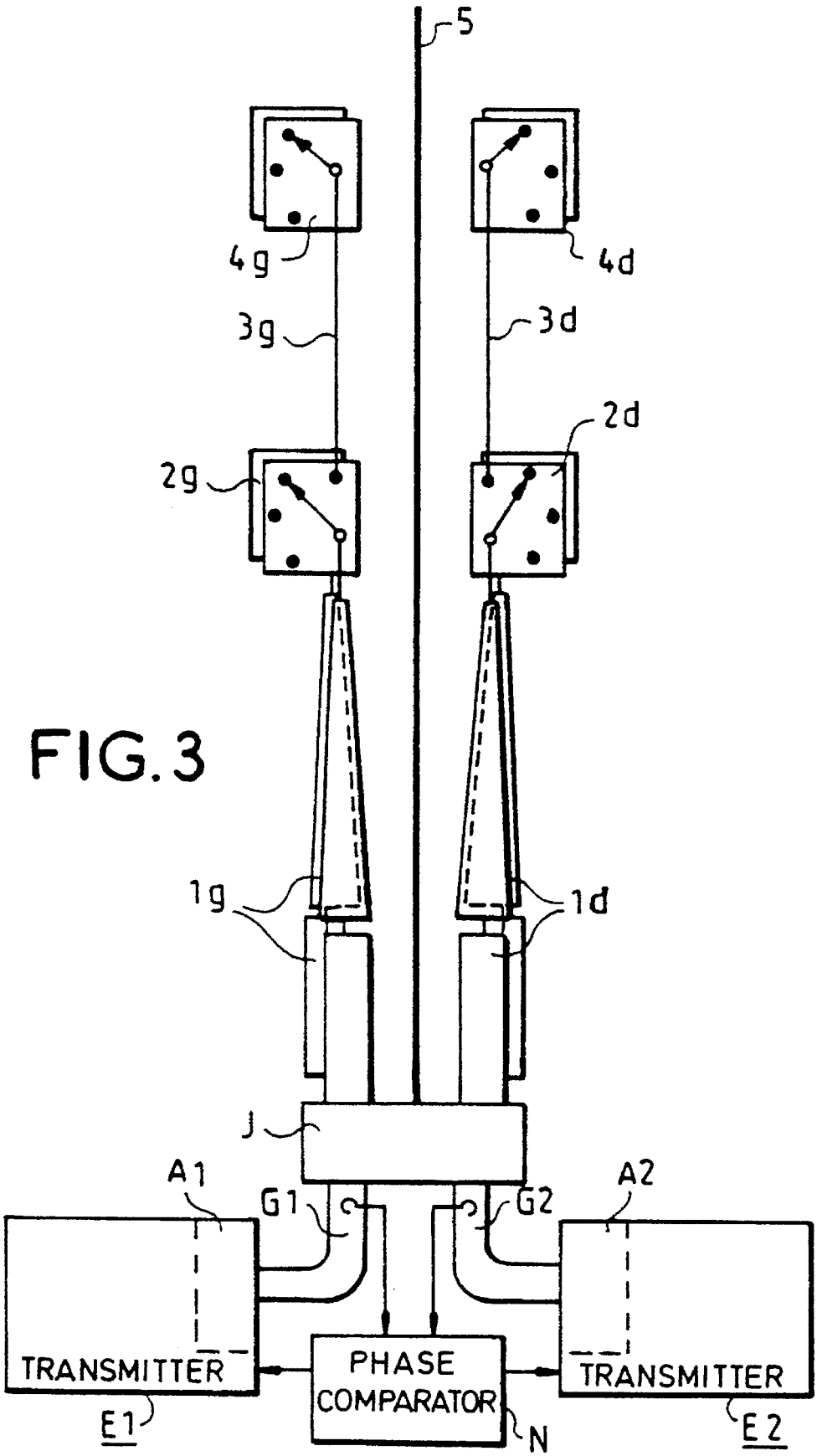

The present invention will be understood more clearly and other features shall appear from the following description and from the appended drawings of which:

FIGS. 1 and 2 show a broadcasting set for the implementation of the invention, FIG. 3 shows means to implement the invention in the set according to FIGS. 1 and 2, FIGS. 4 to 7 show detailed views of elements of FIG. 3.

In the different figures, the corresponding elements are designated by the same references.

MORE DETAILED DESCRIPTION

FIGS. 1 and 2 show a broadcasting set with a double rotary antenna for decameter waves, having a height of 82 meters and a span of 76 meters. This broadcasting set has a support and two antennas proper: one low-range antenna working in the 6 to 11 MHz radio band and one high-range antenna working in the 11 to 26 MHz radio band.

The support has a hollow masonry-work base forming a room, L, within which there are placed transmitters and a mechanical unit with a driving shaft that rotationally drives a ring C positioned on the roof of the room. This ring is fixedly joined to the lower end of a vertical mast M to which there are fixed four horizontal girders P1 to P4 positioned in one and the same vertical plane. Forty small beams such as b1 to b4 and B1 to B6 are fixed to these girders at one of their ends. Rigid bars forming rests such as T1 and T2 or spacers such as T3 are mounted at the ends of the girders P1 to P4 and are positioned substantially in the plane of these girders. The two spacers such as T3 enable the girder P2 to support the girder P1. Stays such as H1 and H2 connect the girders obliquely to the mast. The mast has three parts: a circular cross-sectioned cylindrical vertical column M1 surmounted by a trellised vertical girder M2 itself surmounted by an assembly M3 formed by two bars soldered at one of their ends to form an acute angle with its vertex pointed upwards.

The low-range antenna is an antenna of the HR 4/4/0.5 type, namely it has a curtain of horizontal rigid dipoles H, with a reflector R, with 4 folded half-wave dipoles per line and 4 per column in the curtain, and with a height of the first line of dipoles with respect to the ground equal to 0.5 times the mean operating wavelength of this antenna. The curtain of dipoles of the low range antenna is thus formed by 16 dipoles, d1 to d16, fixed to the unattached ends of 16 of the 40 small beams such as the small beams b1 to b4. These dipoles are positioned in one and the same vertical plane parallel to the vertical plane of the girders P1 to P4. It is between the vertical plane of the dipoles d1 to d16 and the vertical plane of the girders or, more specifically, in the plane of the front faces of the girders P1 to P4 that there is positioned a third vertical plane, parallel to the first two vertical planes, formed by a sheet of horizontal wires and constituting the reflector Rb of the low-range antenna. The horizontal wires of this reflector are held by a bordering cable C1 which passes by the peak of the mast and by the unattached ends of the bars constituting rests such as T1 and T2. The spacing between the horizontal wires of the reflector Rb is maintained by means of vertical cables such as K1 to which the horizontal wires are fixed at regular intervals. The reflector Rb of the low-range antenna has not been drawn entirely in FIG. 1, in order to show the high-range antenna that is behind it and, in FIG. 2, it has been shown schematically by a line of dashes symbolizing its trace in the plane of the figure.

The high-range antenna is an antenna of the HR 4/6/0.75 type, namely it has a curtain of horizontal rigid dipoles H, with a reflector R, with four folded half-wave dipoles per row and six per column in the curtain, and with a height of the first line of dipoles with respect to the ground equal to 0.75 times the mean operating wavelength of this antenna. The curtain of dipoles of the high-range antenna is thus formed by 24 dipoles, d1 to d24, fixed to the unattached ends of 24 of the 40 small beams such as the small beams B1 to B6. These dipoles are positioned in one and the same vertical plane parallel to the vertical plane of the girders P1 to P4. As for the reflector Rh of the high-range antenna, it is formed by a sheet of horizontal wires positioned in the plane of the rear faces of the girders P1 to P4, between the reflector Rb and the array of dipoles of the high-range antenna. The horizontal wires of the reflector Rh are held in a frame demarcated by the upper girder P1 and by bordering cables C2. These cables are held at their lower end by two rests such as T4, which are fixedly joined at one of their ends to the lower girder P4. The spacing between the horizontal wires of the reflector Rh is maintained by means of vertical cables such as K2 to which the horizontal wires are fixed at regular intervals. Like the reflector Rb, the reflector Rh has not been shown entirely in FIG. 1 in order to show the curtain of dipoles of the high-range antenna that is behind it and in FIG. 2 it has been shown schematically by a line of dashes symbolizing its trace in the plane of the figure.

FIG. 3 is the diagram of the supply to the dipoles of the rotary antenna of FIGS. 1 and 2 as provided within the framework of the invention. For purposes of easier representation and comprehension, the proportions have not been maintained in this figure.

The supply according to FIG. 3 is provided by means of two transmitters E1, E2 positioned inside the room L referred to in the description of FIGS. 1 and 2. This supply system comprises a fixed part located in the room L and a rotating part located in the vertical mast of the antenna. These two parts are separated by a bi-coaxial rotating joint J positioned in the center of the ring C of the antenna and having the same vertical rotation axis as this ring.

The transmitters E1, E2 each have an output circuit constituted by an impedance matching unit A1, A2 and are each connected by a coaxial cable G1, G2 to two coaxial inputs of the rotating joint J. Into the coaxial cables G1, G2 there are inserted measuring probes connected to a phase comparator N. This phase comparator, when put into operation, is used to activate the transmitters E1, E2 so that they transmit in phase.

The joint J is described further below by means of FIGS. 4 and 5. It has two coaxial outputs respectively connected by two symmetrizers 1*d*, 1*g* to the common points of two four-position high-range double switches 2*d*, 2*g*. The high-range switch 2*g* has two sets of three plates and the four double positions of these switches are respectively connected by bifilar lines:

to the supply points of the dipoles D24, D23, D20, D19, D16, D15;

to the supply points of the dipoles D24, D23, D20, D19, D16, D15, D12, D11;

to the supply points of the dipoles D24, D23, D20, D19, D16, D15, D12, D11, D8, D7, D4, D3;

to the first end of a bifilar line 3*g*.

The high-range switch 2*d* is identical to the switch 2*g* and is connected symmetrically to the dipoles D21, D22, D17, D18, D13, D14, D9, D10, D5, D6, D1, D2 and to the first end of a bifilar line 3*d*.

The second ends of the bifilar lines 3*d*, 3*g* are respectively connected to the common points of two three-position low-range double switches 4*d*, 4*g*. Each low-range switch has two groups of three plates and the three double positions of the switch 4*g* are connected by bifilar lines:

to the supply points of the dipoles d13, d14, d9, D10, to the supply points of the dipoles d13, d14, d9, d10, d5, d6, to the supply points of the dipoles d13, d14, d9, d10, d5, d6, d1, d2.

The low-range switch 4*d* is identical to the switch 4*g* and is connected symmetrically to the dipoles d16, d15, d12, d11, d8, d7, d4, d3.

A metal plate 5 positioned inside the mast of the rotary antenna provides for electromagnetic shielding between the two parts of the feeder channels in the paths located in the mast M above the joint J, namely in the paths from the symmetrizers at the place where the feeder lines change from coaxial lines to bifilar lines.

Figure 4:
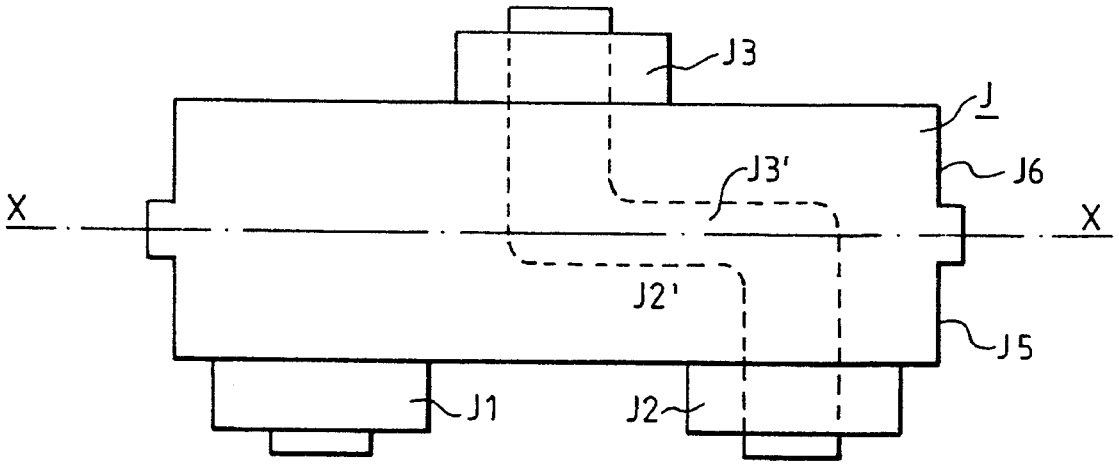
Figure 5:
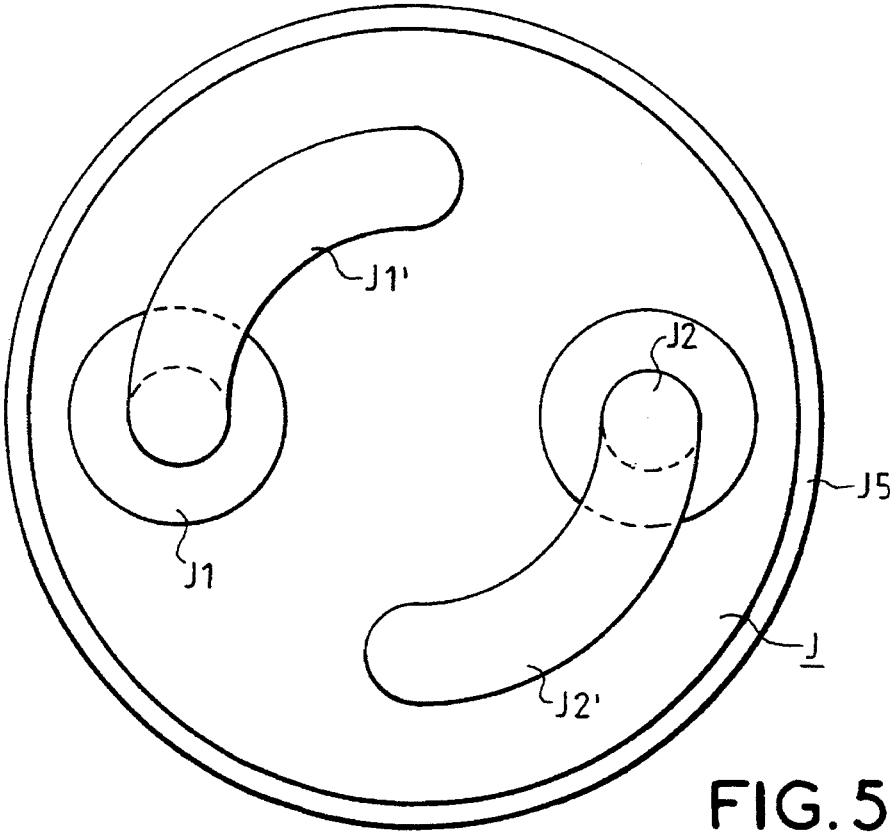

FIGS. 4 and 5 show views of the joint J of FIG. 3. The joint is formed by two identical half-joints, each of them constituting a half-pack. These half-packs are located on either side of a line XX in FIG. 4 and are in sliding contact along a circular zone located in a plane that is perpendicular, along XX, to the plane of FIG. 4. That one of the half-packs which is located below the line XX is fixedly joined to the room L shown in FIGS. 1 and 2 while that one of the half-packs which is located above the XX is fixedly joined to the rotating part of the rotary antenna. FIG. 5 shows the half-joint fixedly joined to the room, namely the fixed half-joint. It is seen in a top view in this figure. It has a metal half-pack J5 with two coaxial connectors J1, J2. The external conductor of the coaxial connectors is soldered to the half-pack and the internal conductor is extended first of all vertically and then horizontally by a crescent-shaped plate J1' in the half-pack. The plate is designed to provide for a sliding contact in the plane which already contains the sliding contact zone between the two half-packs. In the same way, the upper half-joint has a metal half-pack J6 and two coaxial connectors J3, J4 with a plate J3', J4', but only the connector J3 is seen in FIG. 4. The connector J4 is concealed by the connector J3 since, in this figure, the half-packs are rotated by 90° with respect to each other. The position shown in FIG. 4 is the one wherein the plates of the output connectors J3, J4 of the joint precisely overlap the plates J1, J2 of the input connectors. To make it easier to understand the drawing, only the parts of the connectors J2, J3 contained in the pack J have been shown as if seen by transparency.

FIG. 6 shows a known type of symmetrizer as described especially in the French patent 2 556 508 filed on Dec. 13, 1983 and as used to form the symmetrizers 1*d*, 1*g* according to FIG. 3. This is a symmetrizer to couple a coaxial line to a bifilar line. This symmetrizer comprises, in series, a section of coaxial cable 10 and a symmetrical bifilar line 12 with a conductor 13 in parallel on the section of coaxial cable. In this symmetrizer, the symmetrical line 12, which has a length L, is designed to have, between its ends, an impedance variation Z=f(x) with x between zero and the length of the line 12 which, in plane rectilinear coordinates, has the shape of an S.

In FIG. 3, the symmetrizers 1*d*, 1*g* are shown with the two elements of the symmetrical bifilar line seen from the top but slightly offset while in FIG. 6 the two elements of the symmetrical bifilar line are shown in a side view. By contrast, in these two figures, the conductors such as 13 in FIG. 6 have been shown each time in the plane of the figure so as to avoid their being identified with the output of the internal conductor of the coaxial cable section.

FIG. 7 will enable a description of the working of the switch 2*g*. This figure shows that the dipoles D3, D4, D7, D8, D11, D12, D15, D16, D19, D20, D23, D24 form three groups supplied respectively by three distinct lines L1, L2, L3. The line L1, having a characteristic impedance of $\frac{2}{3}Zo$, supplies a first group formed by the dipoles D15, D16, D19, D20, D23, D24; the line L2, having a characteristic impedance 2Zo, supplies the second group formed by the dipoles D11, D12 and the line L3, having a characteristic impedance Zo, supplies the third group formed by the dipoles D3, D4, D7, D8. The lines L1, L2, L3 respectively reach the distribution ports formed by the terminals 1*a*, 2 and 3 of the switch 2*g* which has nine terminals 1*a*, 1*b*, 2–8 and fixed or moving links between certain of these terminals. These links are designed to enable the supply either of the line L1 alone or of the lines L1 and L2 or of the lines L1, L2 and L3 or of the line 3*g* having an impedance $\frac{2}{3}Zo$ from a feeder line E having a characteristic impedance $\frac{2}{3}Zo$ reaching the common port formed by the terminal 7. This line E is the line coming from the symmetrizer 1*g* of FIG. 3.

The terminal 7 is coupled to a mobile arm which, in pivoting, is capable of taking four positions, three of which are shown respectively by a sequence of crosses, a sequence of lines and a sequence of dots. Similarly, the terminal 2 is coupled to two mobile arms which, in pivoting, can each take four positions, three of which are shown respectively by sequences of crosses, lines and dots.

The there mobile arms are mechanically connected in such a way that they can simultaneously take only one out of four positions: the three positions identified by crosses, lines or dots and a fourth position where only the link between the terminals 7 and 8 is provided in order to connect the line E directly to the line 3*g*.

The terminals 1*a* and 1*b* are connected by a very short line H with a uniform characteristic impedance of $\frac{2}{3}Zo$.

In the first position, identified by crosses, the terminal 7 is connected to the terminal 1*b* and the terminal 1*a* is not connected to the terminal 2 so much so that only the line L1 and therefore the dipoles D15, D16, D19, D20, D23, D24 are supplied.

In the second position, identified by lines, the terminal 7 is connected to the terminal 5 and the terminal 2 to the terminals 1*a* and 4. Since, between the terminals 4 and 5, an impedance transformer Tr1 sets up a fixed link, the lines L1 and L2 and therefore the dipoles D11, D12, D15, D16, D19, D20, D23, D24 are supplied while the dipoles D3, D4, D7, D8 are not supplied. The impedance transformer Tr1 is a wideband transformer designed to provide for the impedance matching between the line E having the characteristic impedance of $\frac{2}{3}Zo$ and the lines L1, L2 with respective characteristic impedance values of $\frac{2}{3}Zo$ and 2Zo. Since the lines L1 and L2 are supplied in parallel, they correspond to a single line having a characteristic impedance of $$\frac{\frac{2}{3}Zo \times 2Zo}{\frac{2}{3}Zo + 2Zo} = \frac{Zo}{2}.$$

The transformer Tr1 is therefore designed to transform 2Zo/3 into Zo/2.

In the third position, identified by dots, the terminal 7 is connected to the terminal 6 and the terminal 2 to the terminals 1*a* and 3. Since, between the terminals 3 and 6, an impedance transformer Tr2 sets up a fixed link, there is a supply provided to the three lines L1, L2, L3 and, therefore, to the eight dipoles. The transformer Tr2 too is a wideband impedance transformer designed for the impedance matching between the line E having the characteristic impedance of $\frac{2}{3}Zo$ and the lines L1, L2, L3 having respective characteristic impedance values of $\frac{2}{3}Zo$, 2Zo and Zo. Since the lines L1, L2, L3 are supplied in parallel, they correspond to a single line with a characteristic impedance of $$\frac{\frac{2}{3}Zo \times 2Zo \times Zo}{\frac{2}{3}Zo \times 2Zo + \frac{2}{3}Zo \times Zo + 2Zo \times Zo} = \frac{Zo}{3}.$$

The transformer Tr2 is therefore designed to provide for the transformation of $\frac{2}{3}Zo$ into ZO/3.

The switch 2*d* is identical to the switch 2*g* and the switches 4*d*, 4*g* are wired to ensure the configurations HR 2/2, HR 2/3 and HR 2/4 respectively in their three positions. These three switches will therefore not be described in greater detail.

The rotary antenna that has just been described can therefore be used for transmission in several configurations of half-curtains and for choosing, among the four right-hand or left-hand half-curtains, that curtain which will be connected to the transmitter E1 shown in FIG. 1 and that curtain which will be connected to the transmitter E2. It is clear that a transmitter can be connected to a right-hand half-curtain as well as to a left-hand half-curtain, the link being a function of the position of the mobile part of the rotary antenna with respect to the fixed part and that, for a given position of the rotary antenna, the transmitter E1 for example could be connected either to the high-range left-hand half-curtain or to the low-range right-hand half-curtain.

In view of these possibilities given by the rotary antenna that has just been described, four types of transmissions can be achieved:

two transmissions directed in azimuthal directions at 180° with respect to each other, the transmitter E1 transmitting on a frequency F1 and being connected, for example, to the high-range left-hand half-curtain, the transmitter E2 being then connected to the low-range or high-range left-hand half-curtain and transmitting on a frequency F2 with a sufficient difference between F1 and F2 to prevent disturbances for example $|F1-F2| \geqq 0.1(F1+F2)$.

two transmissions directed in azimuthal directions at 180° with respect to each other, the two transmitters E1, E2 transmitting on one and the same frequency. In this case, a high degree of decoupling between the two curtains of dipoles must be ensured. This means that the two reflectors Rb, Rh should have sufficient height and width in relation respectively to the low-range and high-range dipole curtains and should have a spacing between the horizontal wires constituting them that is small enough with respect to the wavelengths of the low-range and high-range wavelengths respectively.

two transmissions directed in one and the same azimuthal direction, the transmitter E1 transmitting on a frequency F1 and being connected, for example, to the low-range left-hand half-curtain, the transmitter E2 being then connected to the low-range right-hand half-curtain and transmitting on a frequency F2 with, here again, a difference in frequency that is sufficient to prevent disturbances, for example $|F1-F2| \geqq 0.1(F1+F2)$.

one and the same transmission on a complete curtain of the rotary antenna, namely throughout the high-range curtain or throughout the low-range curtain, the transmitter E1 supplying, for example, the low-range left-hand half-curtain and the transmitter E2 supplying the low-range right-hand half-curtain. For this type of transmission, the output-power values of the two transmitters must be adjusted to the same value and the output signals of these transmitters should be in phase. This identity of phase is obtained by means of the phase comparator N according to FIG. 3, which in a standard way, adjusts the respective phases of the transmitters E1, E2 so as to nullify the phase difference between the signals that it measures with these two probes.

The present invention is not limited to the example described. Thus, in particular, it is possible to effect simultaneous transmission by the entire high-range curtain in one direction and the entire low-range curtain in the opposite direction through the addition, in FIG. 3, of a first switch at the input of the switch 2*g* in order to shunt a part of the signal from the transmitter E1 to the input of the switch 2*d* and a second switch at the input of the switch 2*d* in order to enable the breaking of the link between the transmitter E2 and the switch 2*d* and its replacement with a link between the transmitter E2 and the inputs of the switches 4*d* and 4*g*.

The invention can also be applied to a rotary antenna having only one curtain of dipoles in order to enable two types of transmission:

two transmissions directed in one and the same azimuthal direction, one transmission on the complete curtain.

Similarly, the switches of dipoles may be eliminated. Thus, in the embodiment described, the switches 4*d*, 4*g* may be eliminated and the switches 2*d*, 2*g* replaced by a two-position switch to choose between the high-range curtain and the low-range curtain.

What is claimed is:

1. A broadcasting set formed by transmission means and a rotary antenna, the transmission means comprising two transmitters each with one output impedance matching unit and supply means for the antenna, the antenna comprising a support with a fixed base, a vertical mast, a bi-coaxial rotating joint positioned between the base and the mast, m, with m as a positive integer smaller than 3, vertical reflector curtains and n, with an as an integer and $m \leqq n < 3$, parallel vertical curtains of rigid dipoles fixedly joined to the mast, each associated with one of the reflector curtains, the supply means having two distinct channels that respectively leave the two transmitters, go to the joint and rise within the mast up to the level of the dipoles to respectively supply at least certain of the dipoles of two distinct vertical portions of the n curtains of dipoles, the channels each comprising a symmetrizer positioned in the mast, wherein a metal wall in said mast separates the two channels during their passage in the mast and wherein each of said channels has a channel switch in order to enable the choice of whether the distinct vertical portion will belong to either one of the curtains of dipoles, whereby two simultaneously transmissions are enabled from said rotary antenna.

2. A broadcasting set according to claim 1, wherein n is equal to 2.

3. A broadcasting set according to claim 1, wherein the channels comprise connection means to enable the connection, in the distinct vertical portions at which the two channels end, of only a part of the dipoles.

4. A broadcasting set according to claim 1, comprising a servo-control circuit to measure the phase difference between the output signals of the two transmitters and to control the two transmitters so that this phase difference gets cancelled.

* * * * *